US009054476B1

(12) United States Patent
Reynolds

(10) Patent No.: US 9,054,476 B1
(45) Date of Patent: Jun. 9, 2015

(54) ROTARY APPLIANCE BASE ASSEMBLY

(71) Applicant: Jason L. Reynolds, Maeystown, IL (US)

(72) Inventor: Jason L. Reynolds, Maeystown, IL (US)

( * ) Notice: Subject to any disclaimer, the term of this patent is extended or adjusted under 35 U.S.C. 154(b) by 88 days.

(21) Appl. No.: 13/913,973

(22) Filed: Jun. 10, 2013

(51) Int. Cl.
*H01R 39/00* (2006.01)
*H01R 39/64* (2006.01)

(52) U.S. Cl.
CPC ..... *H01R 39/64* (2013.01)

(58) Field of Classification Search
USPC ..... 439/21, 534, 11, 13
IPC ..... H01R 35/04,35/02, 13/518, 31/06, H01R 39/64, 39/643, 2103/00
See application file for complete search history.

(56) References Cited

U.S. PATENT DOCUMENTS 2,890,088 A 6/1959 Lepry et al.
3,652,972 A 3/1972 Kreider
3,794,952 A * 2/1974 Dowis ..... 439/21
5,080,322 A * 1/1992 Harley ..... 248/349.1
5,243,434 A * 9/1993 Nodama ..... 348/827
5,421,271 A 6/1995 Sui
D387,585 S 12/1997 Shields
5,765,796 A * 6/1998 Lanus ..... 248/349.1
6,953,179 B2 * 10/2005 Lai ..... 248/522
7,296,775 B2 11/2007 Mayer

* cited by examiner

*Primary Examiner* — Hien Vu

(57) ABSTRACT

A rotary appliance base assembly for supporting an appliance includes a base that may be positioned on a support surface. A platform is operationally coupled to the base so the platform supports an appliance. A column is coupled to the platform. An electrical outlet is coupled to the column so the appliance is operationally coupled to the electrical outlet. A tubular coupling member is coupled to the column. The electrical outlet is operationally coupled to the tubular coupling member. A power cord is coupled to the base. An end of the power cord is operationally coupled to the tubular coupling member so the power cord remains stationary when the platform is moved.

12 Claims, 7 Drawing Sheets

ROTARY APPLIANCE BASE ASSEMBLY

BACKGROUND OF THE DISCLOSURE

Field of the Disclosure

The disclosure relates to rotary appliance base devices and more particularly pertains to a new rotary appliance base device for supporting an appliance.

SUMMARY OF THE DISCLOSURE

An embodiment of the disclosure meets the needs presented above by generally comprising a base that may be positioned on a support surface. A platform is operationally coupled to the base so the platform supports an appliance. A column is coupled to the platform. An electrical outlet is coupled to the column so the appliance is operationally coupled to the electrical outlet. A tubular coupling member is coupled to the column. The electrical outlet is operationally coupled to the tubular coupling member. A power cord is coupled to the base. An end of the power cord is operationally coupled to the tubular coupling member so the power cord remains stationary when the platform is moved.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
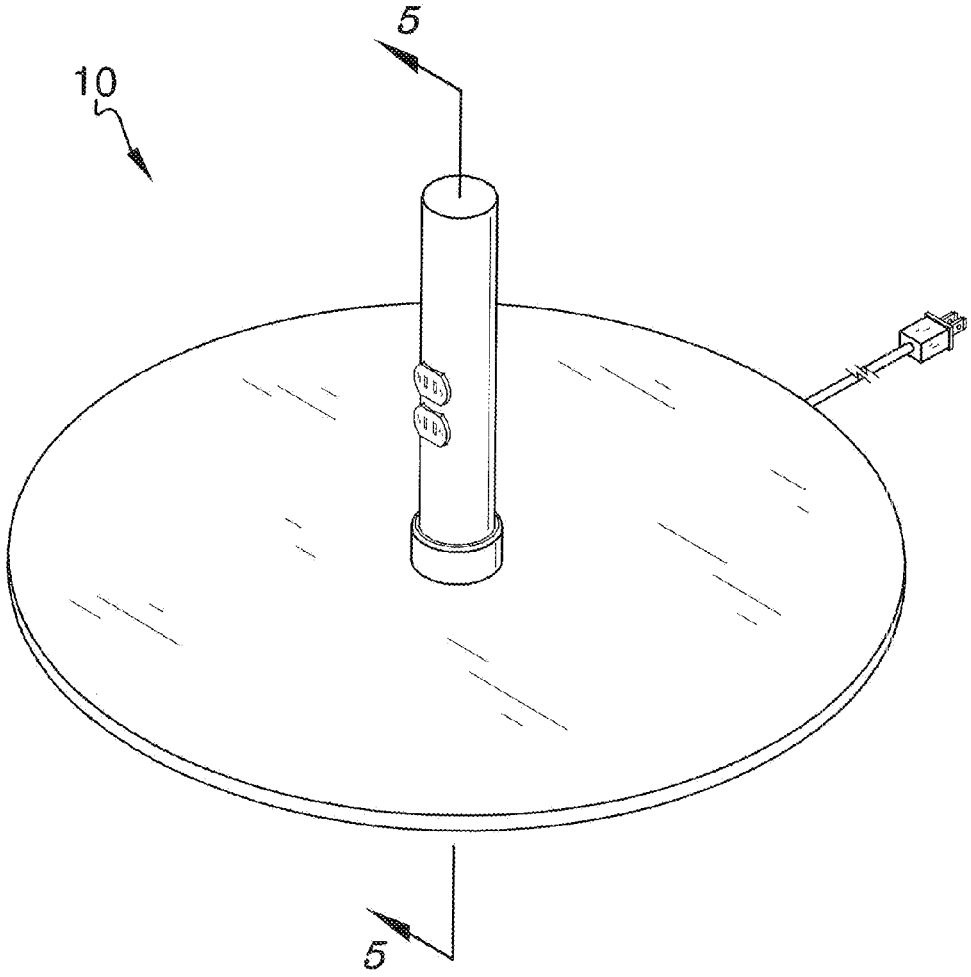
FIG. 1 is a perspective view of a rotary appliance base assembly according to an embodiment of the disclosure.
Figure 2:
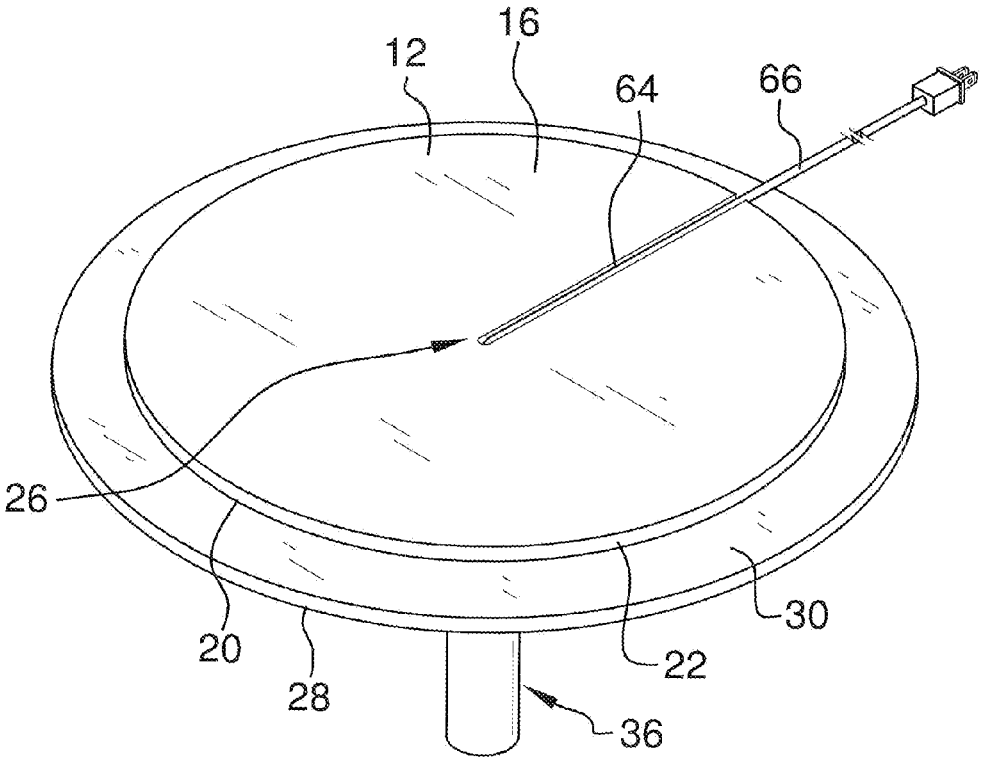
FIG. 2 is a bottom perspective view of an embodiment of the disclosure.
Figure 3:
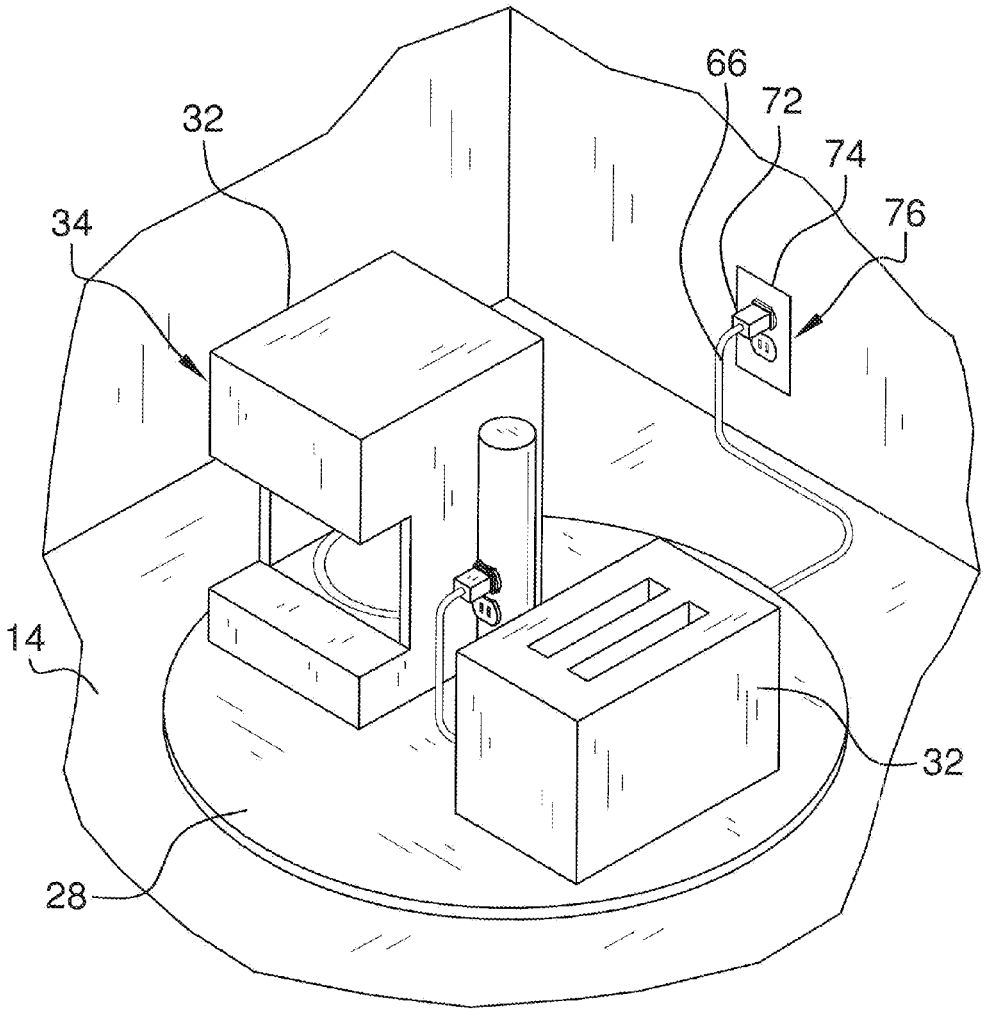
FIG. 3 is a top perspective view of an embodiment of the disclosure.
Figure 4:
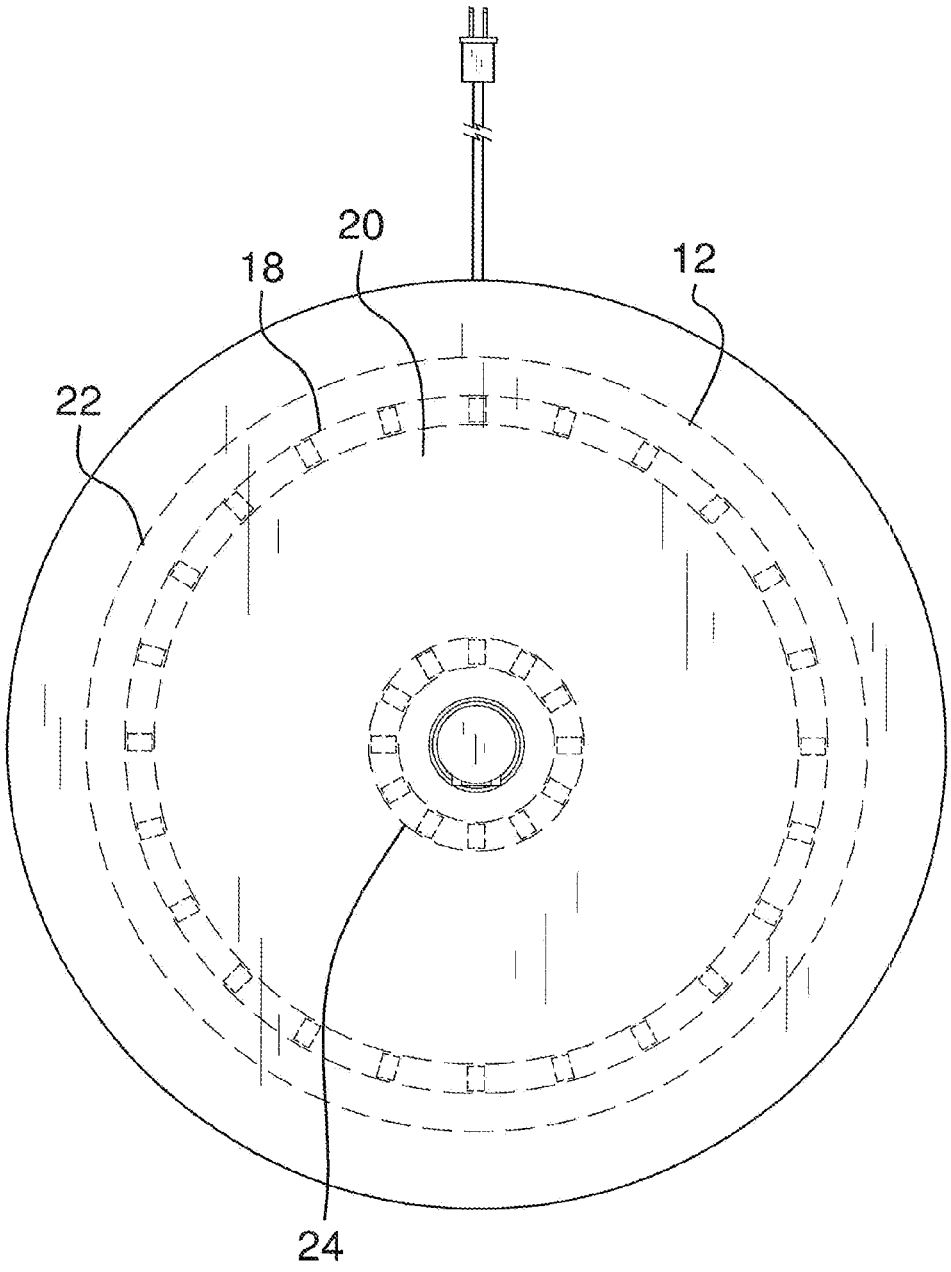
FIG. 4 is a top view of an embodiment of the disclosure.
Figure 5:
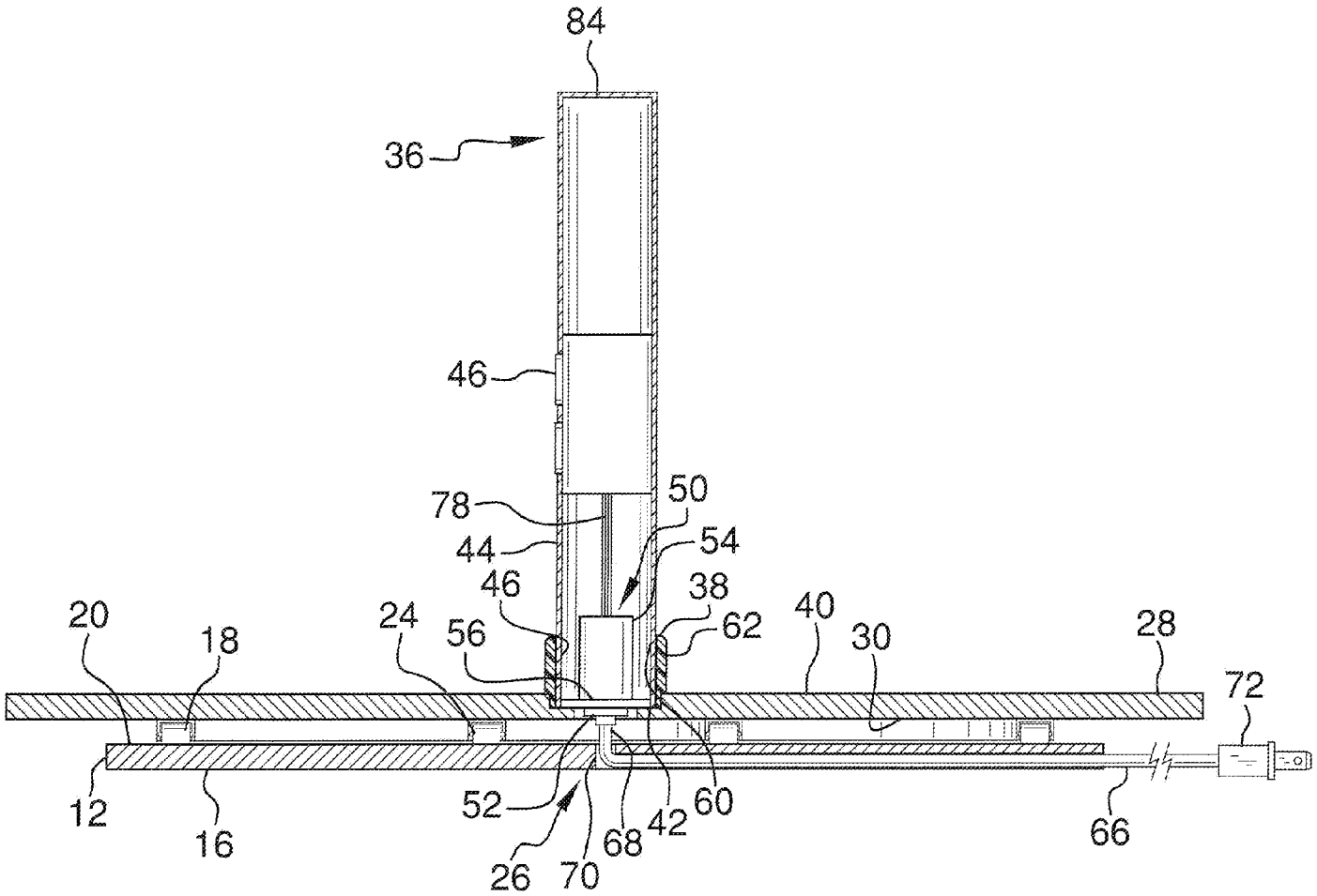
FIG. 5 is a cross sectional view taken along line 5-5 of FIG. 1 of an embodiment of the disclosure.
Figure 6:
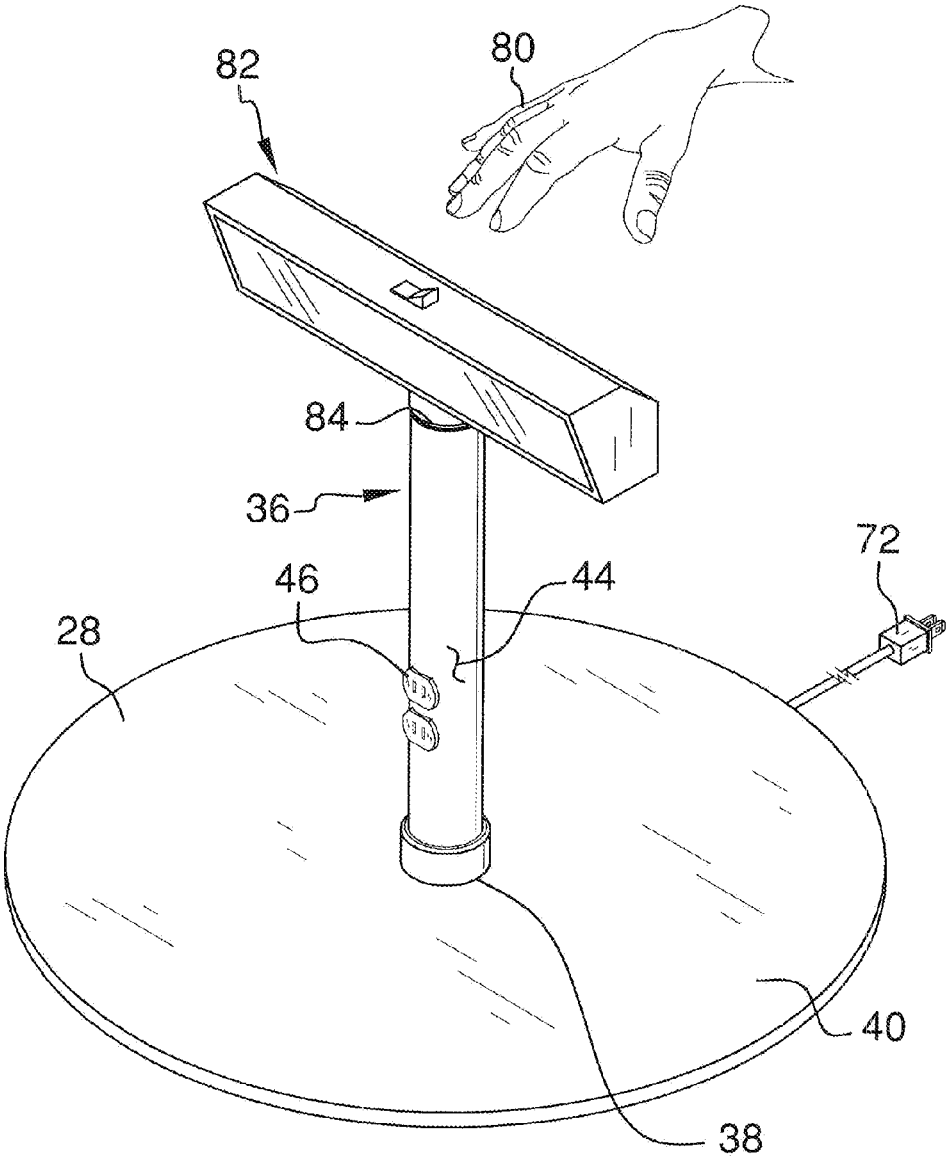
FIG. 6 is an in use view of an embodiment of the disclosure.
Figure 7:
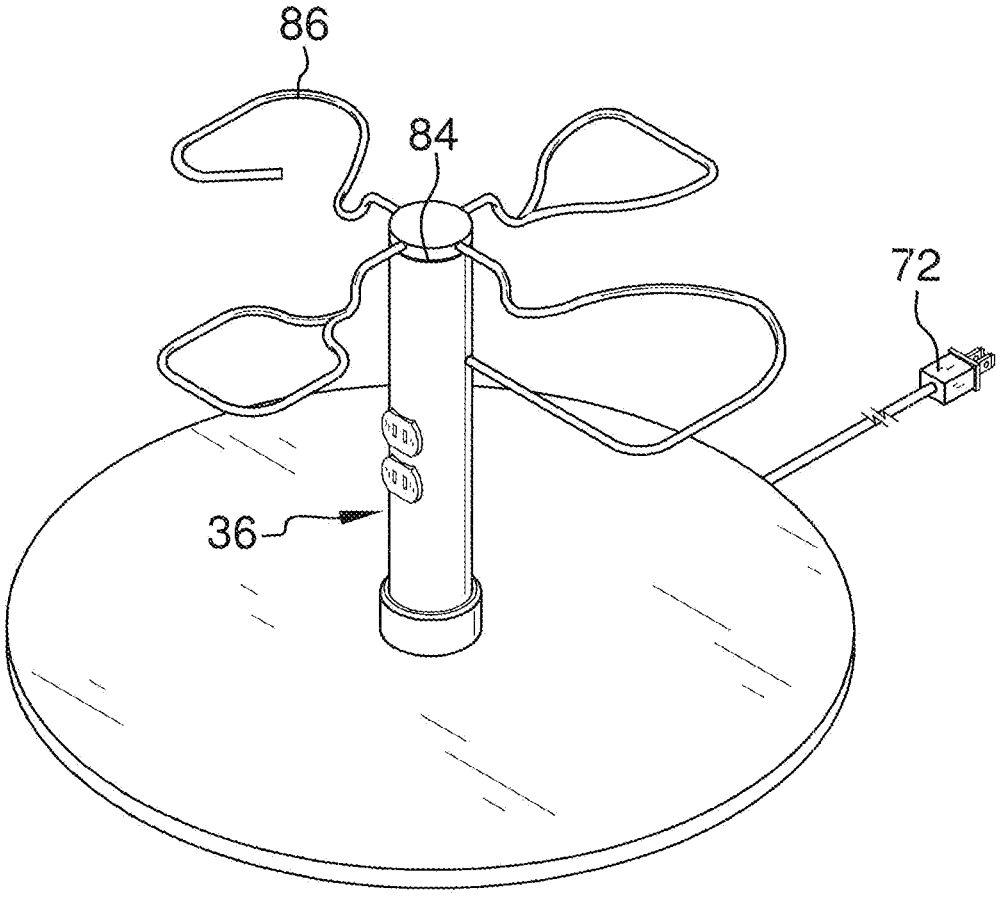
FIG. 7 is an alternative in use view of an embodiment of the disclosure.

With reference now to the drawings, and in particular to FIGS. 1 through 7 thereof, a new rotary appliance base device embodying the principles and concepts of an embodiment of the disclosure and generally designated by the reference numeral 10 will be described.

As best illustrated in FIGS. 1 through 7, the rotary appliance base assembly 10 generally comprises a base 12 that may be positioned on a support surface 14 so a bottom side 16 of the base 12 abuts the support surface 14. The base 12 has a circular shape and may have a diameter between 25 cm and 46 cm. An outer bearing 18 is coupled to a top side 20 of the base 12 so the outer bearing 18 is positioned proximate a curved outer edge 22 of the base 12. The outer bearing 18 forms a closed loop so the outer bearing 18 is curvilinear with the curved outer edge 22 of the base 12. An inner bearing 24 is coupled to the top side 20 of the base 12 so the inner bearing 24 is positioned proximate a center 26 of the base 12. The inner bearing 24 forms a closed loop so the inner bearing 24 defines a concentric circle with respect to the outer bearing 18. Each of the inner 24 and outer 18 bearings may be a ball bearing track of any conventional design.

A platform 28 includes a bottom side 30 of the platform 28 that is coupled to the inner 24 and outer 18 bearings. The platform 28 is spaced apart from and is rotatably coupled to the base 12 so the platform 28 may supports an appliance 32. The appliance 32 may be one of a plurality of electrical kitchen appliances 34 of any conventional design. Additionally, the platform 28 may be selectively rotated to position a selected one of the plurality of electrical kitchen appliances 34 at a selected position. The platform 28 may have a diameter between 31 cm and 61 cm.

A column 36 is coupled to the platform 28 and the column 36 has a hollow, cylindrical shape. The column 36 may have a length between 30 cm and 38 cm and a diameter between 5 cm and 8 cm. A centrally positioned receiver 38 is coupled to a top side 40 of the platform 28. The centrally positioned receiver 38 insertably receives a bottom end 42 of the column 36 so an outer surface 44 of the column 36 abuts an inner surface 46 of the centrally positioned receiver 38. The centrally positioned receiver 38 retains the column 36 on the top side 40 of the platform 28 so the column 36 is directed upwardly from the top side 40 of the platform 28. An electrical outlet 46 is coupled to the column 36 so the appliance 32 may be electrically coupled to the electrical outlet 46. The electrical outlet 46 may be one of a pair of electrical outlets 46 each positioned on the outer surface 44 of the column 36 proximate a middle 48 of the column 36.

A tubular coupling member 50 comprises a bottom portion 52 of the tubular coupling member 50 that is rotatably and electrically coupled to a top portion 54 of the tubular coupling member 50. The tubular coupling member 50 may be comprised of a rigid and electrically conductive material. The tubular coupling member 50 further comprises a lip 56 coupled to and extending outwardly from an outer surface 58 of the top portion 54 of the tubular coupling member 50. Additionally, an exposed edge 60 of the lip 56 is coupled to an inside surface 62 of the column 36 so the bottom portion 52 of the tubular coupling member 50 is positioned proximate the bottom end 42 of the column 36. The top portion 54 of the tubular coupling member 50 rotates with the platform 28 and the bottom portion 52 of the tubular coupling member 50 remains stationary when the platform 28 is rotated.

A groove 64 extends into the bottom side 16 of the base 12 so the groove 64 extends between the curved outer edge 22 of the base 12 and the center 26 of the base 12. A power cord 66 is positioned within the groove 64 so a coupled end 68 of the power cord 66 extends upwardly through a centrally positioned cord aperture 70 in the base 12. The power cord 66 is electrically coupled to the bottom portion 52 of the tubular coupling member 50 so the power cord 66 remains stationary when the platform 28 is selectively rotated. A free end 72 of the power cord 64 is selectively electrically coupled to a power source 74. The power source 74 may comprise an electrical outlet 76 of any conventional design.

A conductor 78 is electrically coupled between the top portion 54 of the tubular coupling member 50 and the electrical outlet 46 so the electrical outlet 46 is electrically coupled to the power cord 66. The conductor 78 may be one of a pair of conductors 78 each electrically coupled between the top portion 54 of the tubular coupling member 50 and an associated one of the pair of electrical outlets 46. The tubular coupling member 50 prevents the power cord 66 from becoming twisted while the platform 28 is rotated, as well as providing continuous electrical power to the conductor 78 while the platform 28 is rotated or while the platform 28 is stationary.

A light 82 is provided that may be selectively positioned within an open top end 84 of the column 36 to provide light for a user 80. The light 82 may be a fluorescent light fixture of any conventional design. Additionally, a hanging rack 86 is provided that may be selectively positioned in the open top end 84 of the column 36. The user 80 may position an item on the hanging rack 86 so the item is retained on the hanging rack 86 for storage.

In use, a selected number of electrical kitchen appliances 34 is placed on the top side 40 of the platform 28, and the electrical kitchen appliances 34 are electrically coupled to the electrical outlet 46 on the column 36. A user 80 electrically couples the power cord 66 to the power source 74. Continuing, the user 80 selectively rotates the platform 28 to bring a selected electrical kitchen appliance 34 into an accessible position. The tubular coupling member 50 allows the electrical kitchen appliances 34 that are positioned on the platform 28 to remain in constant electrical communication with the power source 74 during rotation of the platform 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A rotary appliance base assembly comprising:

a base configured to be positioned on a support surface;

a platform rotatably coupled to said base wherein said platform supports an appliance;

a column coupled to said platform such that said column rotates with said platform;

an electrical outlet coupled to said column wherein the appliance is operationally coupled to said electrical outlet;

a tubular coupling member coupled to said column, said electrical outlet being operationally coupled to said tubular coupling member;

a power cord coupled to said base, an end of said power cord being operationally coupled to said tubular coupling member wherein said power cord remains stationary when said platform is moved;

said tubular coupling member comprising a bottom portion of said tubular coupling member being rotatably and electrically coupled to a top portion of said tubular coupling member;

a lip extending outwardly from an outer surface of said top portion of said tubular coupling member, said lip being coupled to an inside surface of said column wherein said bottom portion of said tubular coupling member is positioned proximate a bottom of said column.

2. The assembly according to claim 1, further comprising said base being positionable on said support surface wherein a bottom side of said base abuts the support surface.

3. The assembly according to claim 1, further comprising:

an outer bearing coupled to a top side of said base wherein said outer bearing is positioned proximate a curved outer edge of said base; and said outer bearing forming a closed loop wherein said outer bearing is curvilinear with said curved outer edge of said base.

4. The assembly according to claim 1, further comprising:

an inner bearing coupled to a top side of said base wherein said inner bearing is positioned proximate a center of said base; and said inner bearing forming a closed loop wherein said inner bearing defines a concentric circle with respect to said outer bearing.

5. The assembly according to claim 1, further comprising a bottom side of said platform being coupled to an inner and outer bearing wherein said platform is spaced apart from and is rotatably coupled to said base.

6. The assembly according to claim 1, further comprising a centrally positioned receiver coupled to a top side of said platform.

7. The assembly according to claim 6, further comprising said centrally positioned receiver insertably receiving a bottom end of said column wherein an outer surface of said column abuts an inner surface of said receiver wherein said column is retained on and is directly upwardly from said top side of said platform.

8. The assembly according to claim 1, further comprising a groove extending into a bottom side of said base wherein said groove extends between a curved outer edge of said base and a center of said base.

9. The assembly according to claim 1, further comprising said power cord being positioned within a groove wherein a coupled end of said power cord extends upwardly through a cord aperture in said base and is electrically coupled to a bottom portion of said tubular coupling member.

10. The assembly according to claim 1, further comprising a free end of said power cord being selectively electrically coupled to a power source.

11. The assembly according to claim 1, further comprising a conductor electrically coupled between a top portion of said tubular coupling member and said electrical outlet wherein said electrical outlet is electrically coupled to said power cord.

12. A rotary appliance base assembly comprising:

a base configured to be positioned on a support surface wherein a bottom side of said base abuts the support surface;

an outer bearing coupled to a top side of said base wherein said outer bearing is positioned proximate a curved outer edge of said base, said outer bearing forming a closed loop wherein said outer bearing is curvilinear with said curved outer edge of said base;

an inner bearing coupled to said top side of said base wherein said inner bearing is positioned proximate a center of said base, said inner bearing forming a closed loop wherein said inner bearing defines a concentric circle with respect to said outer bearing;

a platform including a bottom side of said platform being coupled to said inner and outer bearings wherein said platform is spaced apart from and is rotatably coupled to said base wherein said platform supports an appliance;

a column coupled to said platform such that said column rotates with said platform, said column having a hollow, cylindrical shape;

a centrally positioned receiver coupled to a top side of said platform, said centrally positioned receiver insertably receiving a bottom end of said column wherein an outer surface of said column abuts an inner surface of said receiver wherein said column is retained on and is directly upwardly from said top side of said platform;

an electrical outlet coupled to said column wherein the appliance is coupled to said electrical outlet;

a tubular coupling member comprising a bottom portion of said tubular coupling member being rotatably and electrically coupled to a top portion of said tubular coupling member, said tubular coupling member further comprising a lip extending outwardly from an outer surface of said top portion of said tubular coupling member, said lip being coupled to an inside surface of said column wherein said bottom portion of said tubular coupling member is positioned proximate a bottom of said column;

a groove extending into said bottom side of said base wherein said groove extends between said curved outer edge of said base and said center of said base;

a power cord positioned within said groove wherein a coupled end of said power cord extends upwardly through a cord aperture in said base and is electrically coupled to said bottom portion of said tubular coupling member wherein said power cord remains stationary when said platform is rotated, a free end of said power cord being selectively electrically coupled to a power source; and a conductor electrically coupled between said top portion of said tubular coupling member and said electrical outlet wherein said electrical outlet is electrically coupled to said power cord.

* * * * *